US005408786A

United States Patent [19]

Konno

[11] Patent Number: 5,408,786

[45] Date of Patent: Apr. 25, 1995

[54] TOMB

[76] Inventor: Katsuhiko Konno, 18-27 Zenkunen 3-Chome, Morioka-shi, Iwate 020, Japan

[21] Appl. No.: 301,728

[22] PCT Filed: Apr. 25, 1991

[86] PCT No.: PCT/JP91/00563

§ 371 Date: Jan. 23, 1992

§ 102(e) Date: Jan. 23, 1992

[87] PCT Pub. No.: WO91/16516

PCT Pub. Date: Oct. 31, 1991

Related U.S. Application Data

[63] Continuation of Ser. No. 778,167, Jan. 23, 1992, abandoned.

[30] Foreign Application Priority Data

Apr. 26, 1990 [JP] Japan ..... 2-113260

[51] Int. Cl.[6] ..... E04H 13/00

[52] U.S. Cl. ..... 52/128; 52/134; 52/136; 52/138; 27/1

[58] Field of Search ..... 52/128, 134, 136, 137, 52/138, 139, 66; 27/4, 35, 1

[56] References Cited

U.S. PATENT DOCUMENTS

| | | | |
|---|---|---|---|
| 853,909 | 5/1907 | Tayntor | 52/134 |
| 859,550 | 7/1907 | Doudna | 52/138 |
| 863,303 | 8/1907 | Moore | 52/134 |
| 1,008,421 | 11/1911 | McKay | 52/134 |
| 1,174,867 | 3/1916 | Jenkins | 52/134 |
| 1,710,118 | 4/1929 | Smidley | 52/66 |

FOREIGN PATENT DOCUMENTS

| | | |
|---|---|---|
| 51-110899 | 2/1975 | Japan . |
| 56-16777 | 2/1981 | Japan . |

*Primary Examiner*—Carl D. Friedman
*Assistant Examiner*—Kien T. Nguyen
*Attorney, Agent, or Firm*—Haynes and Boone; Jeffrey M. Becker

[57] ABSTRACT

The tomb has a bone accommodating chamber inside it and the overall structure is formed like a house. The bone accommodating chamber is enclosed by the wall section on four sides and by the roof section that can be removed from the top of the wall section, so as to prevent ingress of water. The roof section can be taken off the wall section by lifting it, allowing the cinerary urn to be placed inside the tomb with ease.

9 Claims, 6 Drawing Sheets

TOMB

This is a continuation of application Ser. No. 07/778,167, filed on Jan. 23, 1992, now abandoned.

BACKGROUND OF THE INVENTION

1. Field of the Invention

The present invention relates to a tomb built in temples or cemeteries.

2. Prior Art

In conventional tombs, as shown in FIG. 1, a chamber 2 for accommodating cremated remains or bones 1 of the dead is formed underground enclosed by concrete, with a tombstone 3 erected on the ground above the bone accommodating chamber 2. In front of the tombstone 3 an opening 4 is formed that communicates with the chamber 2. The opening 4 is closed by a stone cover 5.

Such conventional tombs, however, have the following drawbacks. That is, since the tombstone 3 is simply placed on the bone accommodating chamber 2 with the opening 4 closed by the stone cover 5, the chamber 2 is not tightly enclosed but there are many gaps through which rain water easily enters, weathering the bones 1 placed inside.

SUMMARY OF THE INVENTION

A primary object of this invention is to provide a tomb which improves the environment of the interior of the tomb, especially the bone accommodating chamber.

A further object of the invention is to provide a tomb which allows easy placement of bones of the dead in the bone accommodating chamber.

Another object of the invention is to provide a tomb which has good air ventilation.

Still another object of the invention is to provide a tomb which has a robust structure.

To achieve the above objectives, in a tomb with a bone accommodating chamber, the present invention constructs the tomb in a house-like structure to enclose the chamber and thereby prevent ingress of water into the chamber.

With this tomb, since the bone accommodating chamber is enclosed to prevent water from entering the interior of the tomb, the bones placed in the chamber are protected against weathering.

In more detail, the tomb as a whole is constructed in the shape of a house and the bone accommodating chamber is enclosed to prevent ingress of water, so that the bones placed in the chamber are not exposed to rain water, thus improving the environment and minimizing the weathering of the bones. Further, since the tomb is constructed in the house-like shape, a greater strength is gained than the conventional tomb in which the tombstone is simply placed on the underground bone accommodating chamber. Thus, the tomb can be prevented from falling as experienced with the conventional ones. Furthermore, the house-like structure provides a good appearance.

In the following, one embodiment of this invention will be described by referring to the accompanying drawings.

DESCRIPTION OF THE PREFERRED EMBODIMENT

Figure 1:
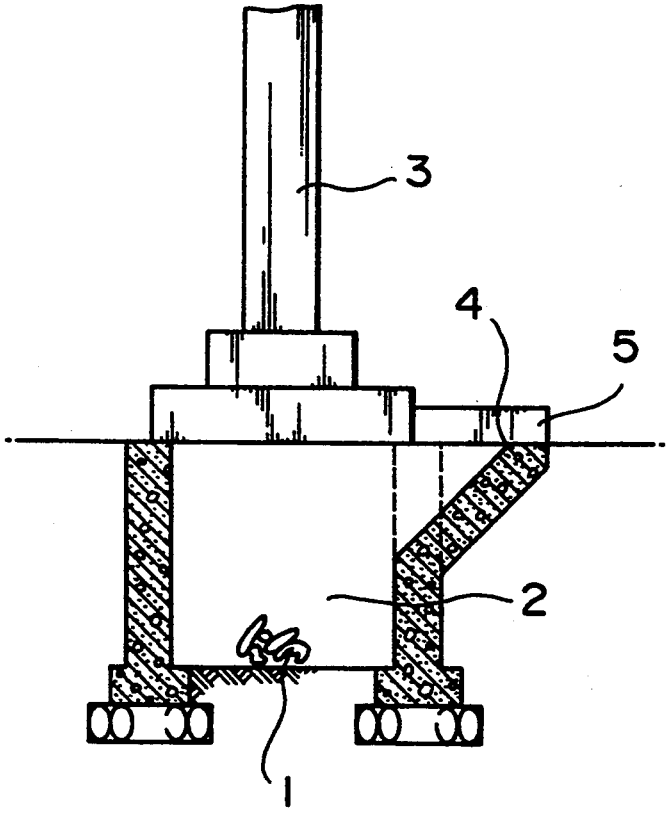
FIG. 1 Prior Art
FIG. 1 is a schematic cross section of a conventional tomb.

As shown in FIGS. 2 through 8, the tomb of this embodiment is constructed in the form of a house. The tomb consists of: a foundation section 10 embedded in the ground, a rectangular base section 11 erected on the foundation section 10, a wall section 12 built on the base section 11, and a roof section 13 mounted at the top of the wall section 12.

Figure 2:
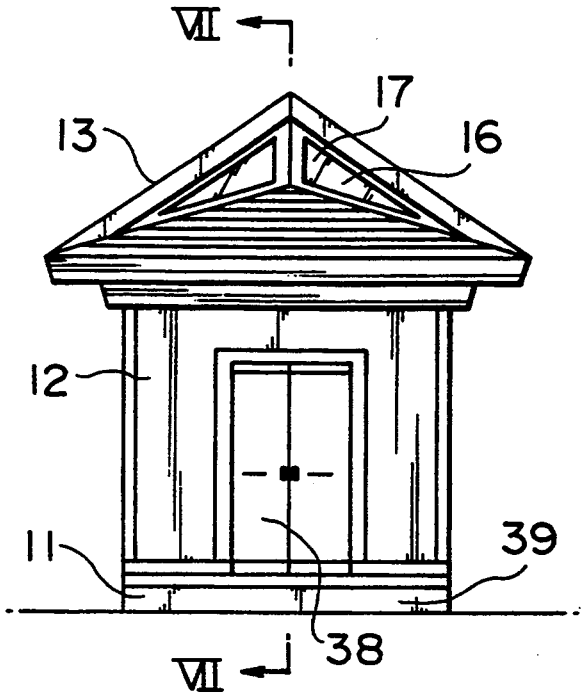
FIG. 2 is a front view of a tomb as one embodiment of the invention.
Figure 3:
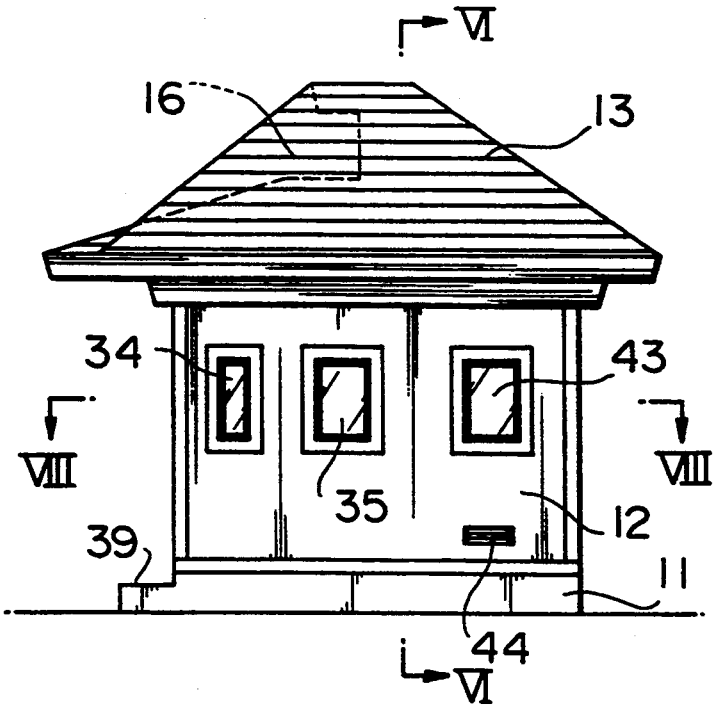
FIG. 3 is a right side view of the embodiment.
Figure 4:
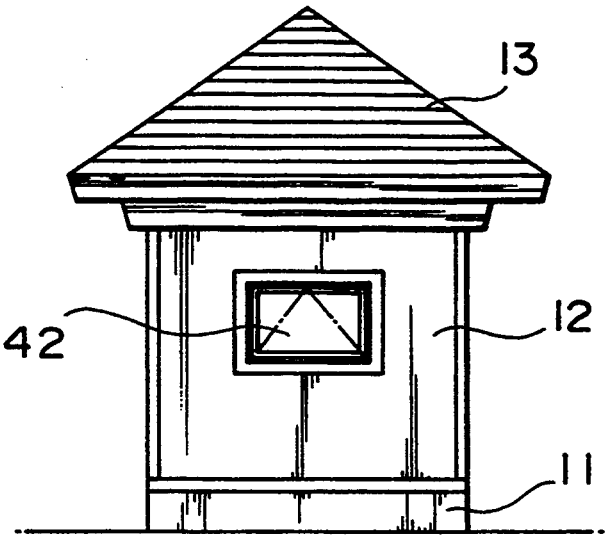
FIG. 4 is a rear view of the embodiment of FIG. 2.
Figure 5:
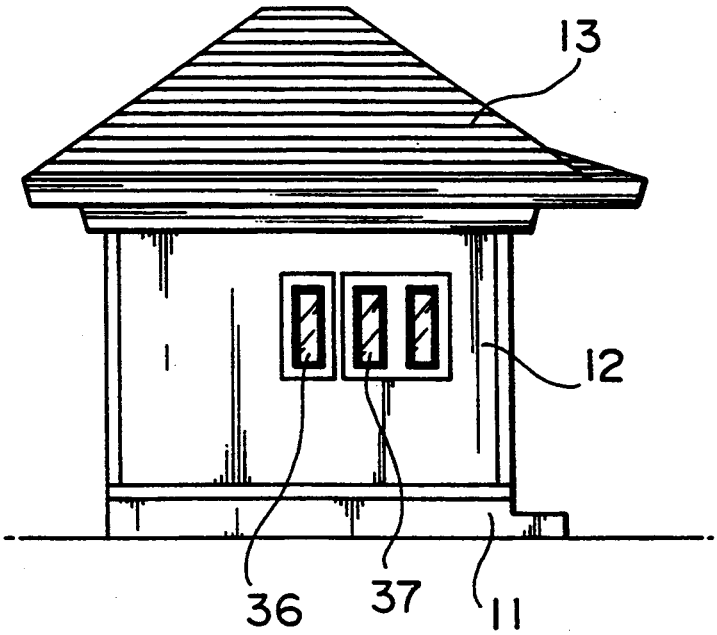
FIG. 5 is a left side view of the embodiment.
Figure 6:
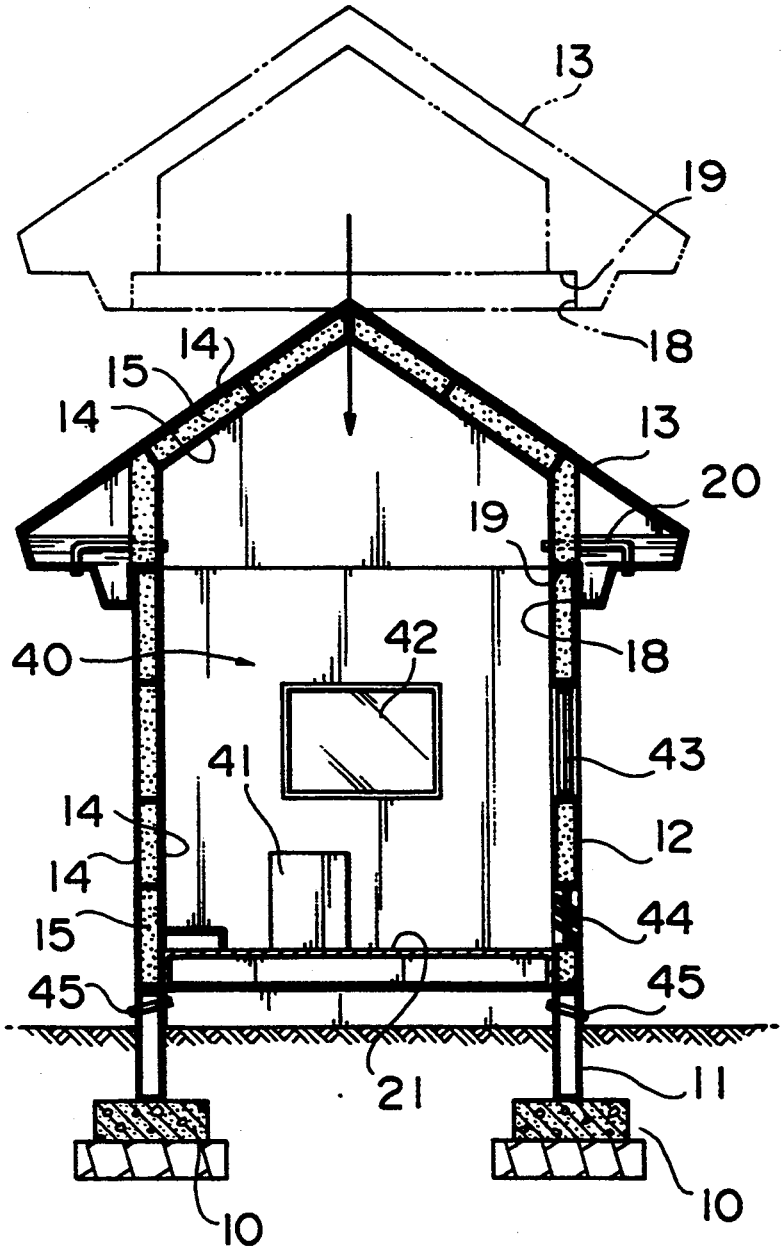
FIG. 6 is a cross-sectional view taken along the line VI—VI of FIG. 3.

The wall section 12 and the roof section 13 are each formed of a pair of parallel plastic plates 14 with a specified gap therebetween and a heat insulating material 15 filled between the plastic plates. The roof section 13, as shown in FIGS. 2 and 3, has inclined surfaces on four sides. One of the inclined surfaces is recessed inwardly and a window 17 is formed at a recessed portion 16. As shown in FIG. 6, the roof section 13 is removably mounted on the wall section 12. The lower end of the roof section 13 forms an opening 18 that fits over the outer circumference of the upper end of the wall section 12. At the inner side of the opening 18 is formed an abutment surface 19 that rests on the upper end surface of the wall section 12 to position the roof section 13 with respect to the wall section 12. Under the eaves of the roof section 13 is provided a pipe 20 that communicates the interior with the open air.

Figure 7:
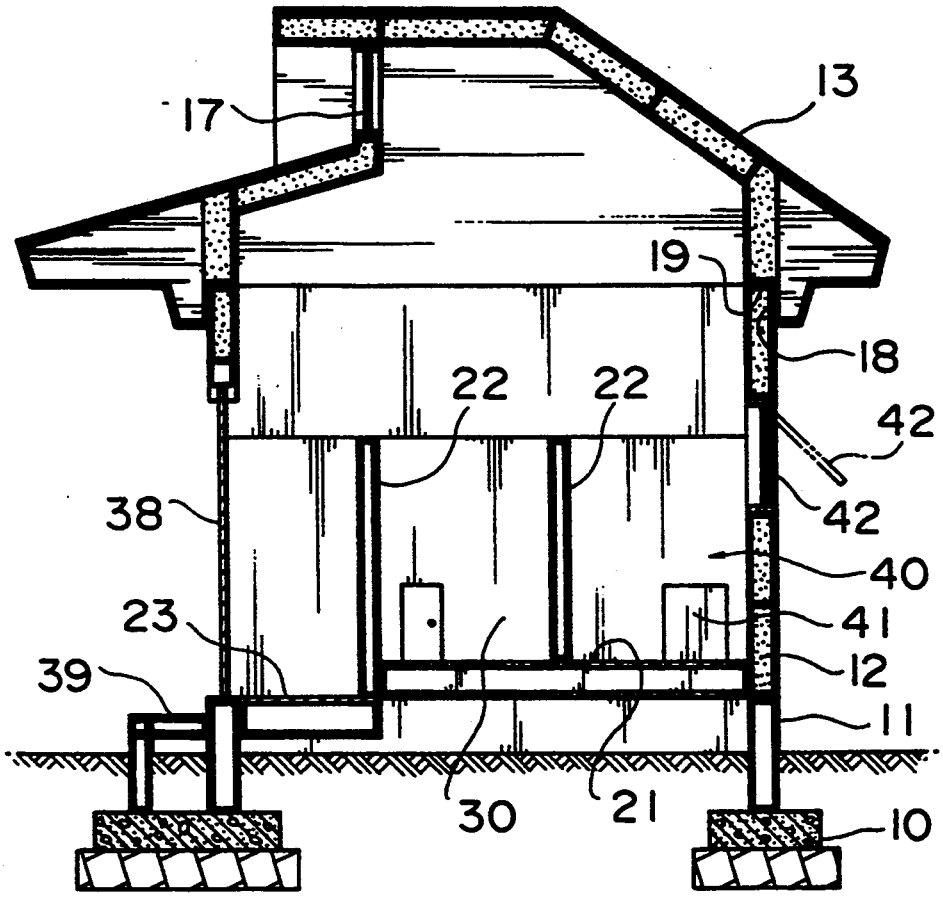
FIG. 7 is a cross-sectional view taken along the line VII—VII of FIG. 2.
Figure 8:
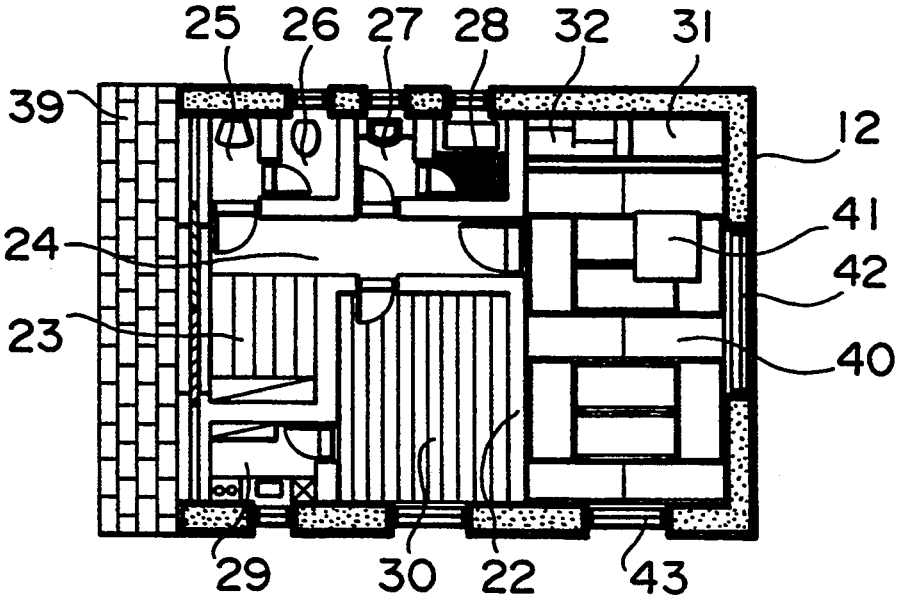
FIG. 8 is a cross-sectional view taken along the line VIII—VIII of FIG. 3.

On the base section 11 is mounted a floor 21, which, as shown in FIGS. 7 and 8, is divided by internal walls 22, lower in height than the wall section 12, to form two or more rooms. In this embodiment, the house-like structure has an entrance hall 23, a passage 24, a washstand 25, a toilet 26, a dressing room 27, a bathroom 28, a kitchen 29, a living room 30, and a Japanese-style room 40 with an alcove 31 and a side-alcove 32. That is, the Japanese-style room 40 is enclosed by the wall section 12, the roof section 13 and the floor 21 to prevent ingress of water.

In the embodiment shown above, the Japanese-style room 40 is formed as a bone accommodating chamber in which a cinerary urn 41 is installed. The wall section 12 of the bone accommodating room 40 is provided with windows 42, 43 that can be opened on hinges to introduce external air into the room. At the lower part of the wall section 12 of the bone accommodating room 42 is provided a normally-closed ventilation opening 44 that automatically opens when a sensor detects the room temperature to be higher than a specified temperature.

The wall of the base section 11 is formed of plastic material and has a pipe 45 passing therethrough which communicates the space under the floor with the open air. Further, the wall section 12 of each room is provided with windows 34, 35, 36, 37. The wall section 12 for the entrance hall is provided with a sliding door 38. Denoted 39 is a porch in front of the entrance hall 23.

In summary, this embodiment has a ventilating means for the bone accommodating room 40, which consists of the pipe 20 communicating the room 40 with external air at all times, the windows 34, 35, 36, 37, 42, 43 that are opened or closed as necessary, the sliding door 38, and the ventilation opening 44 that ventilates the room 40 according to the room temperature.

When the bones are to be placed in the tomb, the roof section 13 is taken off the wall section 12, as indicated by two-dot line in FIG. 6, and the cinerary urn 41 is put in the bone accommodating room 40. After this, the roof section 13 is fitted over the wall section 13. Since the room 40 is accessed by simply removing the roof section 13 which is formed of relatively light materials, i.e. plastic plates 14 and the heat insulating material 15, the cinerary urn 41 can easily be installed. Then, the windows 34, 35, 36, 37, 42, 43 and the slide door 38 are closed.

In this state, the bone accommodating room 40 is enclosed by the wall section 12, the roof section 13 and the floor 21, all of which are formed of plastic plates 14, so that no rain water can enter. As a result, the bone can be protected against weathering. Further, since the pipe 20 under the eaves 13 of the roof section 13 communicates with the bone accommodating room 40, the room is ventilated through the pipe at all times to keep the interior in good condition. The insulating material 15 minimizes a temperature rise in the room 40. But when the inner temperature becomes high as in hot summer, the ventilation opening 44 is automatically opened to promote air circulation, minimizing the temperature rise. The space under the floor is also ventilated to some degree, helping to maintain the environment of the room 40 in good condition. Further, since the tomb is built on the firm foundation 10 embedded in the ground, it is more stable and solid, and has a greater seismic resistance than the conventional tomb in which a tombstone is placed on the ground.

When one makes a visit to the tomb, he or she may open the slide door 38 and windows 34, 35, 36, 37, 42, 43 to introduce external air into the room 40 to remove humidity, helping to maintain the good environment in which the bones are preserved. Because of its house-like appearance and the ability to preserve the bones in good condition, this tomb provides a relief to a person visiting the tomb.

While in the above embodiment the bone accommodating chamber is formed as a Japanese-style room 40, it may be formed into other type of room. It is also possible to provide a basement and install the urn there or make necessary modifications to the bone accommodating chamber. The materials and shape of the house-like structure are not limited to those mentioned above but may be modified as desired.

What is claimed is:

1. A tomb, comprising:

a base having elements extending downwardly therefrom into the ground for securing said base to the ground;

a plurality of walls extending upwardly from said base for defining a bone accommodating chamber;

a roof removably resting upon an upper portion of said walls, said roof having a shoulder extending inwardly from a lower portion of said roof for engaging said upper portion of said walls;

a plurality of partitions extending upwardly from said base within said chamber for defining separate rooms within said chamber to resemble a house interior; and means attached to said walls for ventilating said chamber.

2. The tomb of claim 1 wherein said walls comprise a pair of spaced, parallel plates defining a gap therebetween for receiving a heat insulating material.

3. The tomb of claim 1 wherein said roof further comprises a pair of spaced, parallel plates defining a gap therebetween for receiving a heat insulating material, wherein one of said plates extends farther than said other of said plates for defining said shoulder.

4. The tomb of claim 1 wherein said base is spaced upwardly from the ground by said elements.

5. The tomb of claim 1 wherein said ventilating means comprises a window hinged to an opening in said wall.

6. The tomb of claim 1 further comprising a pipe extending from said chamber through said base for ventilating said chamber.

7. The tomb of claim 1 further comprising a pipe extending from said chamber through said roof for ventilating said chamber.

8. The tomb of claim 1 further comprising a door and a plurality of windows for resembling a home exterior.

9. A tomb of claim 1 further comprising means for sensing temperature within said chamber and means for ventilating said chamber upon said temperature reaching a predetermined value.

* * * * *